US006692247B2

(12) United States Patent
Sewalt

(10) Patent No.: US 6,692,247 B2
(45) Date of Patent: Feb. 17, 2004

(54) CHILD RESISTANT GAS LIGHTERS

(75) Inventor: Carel Sewalt, Onstwedde (NL)

(73) Assignee: Swedish Match Lighters B.V., Am Assen (NL)

( * ) Notice: Subject to any disclaimer, the term of this patent is extended or adjusted under 35 U.S.C. 154(b) by 0 days.

(21) Appl. No.: 10/204,130

(22) PCT Filed: Feb. 27, 2001

(86) PCT No.: PCT/IB01/00416

§ 371 (c)(1),
(2), (4) Date: Aug. 15, 2002

(87) PCT Pub. No.: WO01/69134

PCT Pub. Date: Sep. 20, 2001

(65) Prior Publication Data

US 2003/0031967 A1 Feb. 13, 2003

(30) Foreign Application Priority Data

Mar. 11, 2000 (GB) ..... 0005852

(51) Int. Cl.[7] ..... F23Q 2/16
(52) U.S. Cl. ..... 431/153; 431/277
(58) Field of Search ..... 431/153, 277; F23Q 2/16

(56) References Cited

U.S. PATENT DOCUMENTS

| | | | | | |
|---|---|---|---|---|---|
| 5,217,364 | A | * | 6/1993 | Frigiere | 431/344 |
| 5,271,731 | A | * | 12/1993 | Hsin-Chung | 431/254 |
| 5,439,375 | A | * | 8/1995 | Wang | 431/153 |
| 6,095,796 | A | | 8/2000 | Sung | |
| 6,454,560 | B1 | * | 9/2002 | Chen | 431/153 |
| 2002/0132200 | A1 | * | 9/2002 | Hurng | 431/153 |

FOREIGN PATENT DOCUMENTS

| | | | | |
|---|---|---|---|---|
| GB | 1189300 | * | 4/1970 | F23Q/2/16 |
| GB | 2360083 A | * | 9/2001 | F23Q/2/16 |
| WO | WO 99/46539 | | 9/1999 | |

* cited by examiner

*Primary Examiner*—Ira S. Lazarus
*Assistant Examiner*—James G. Barrow
(74) *Attorney, Agent, or Firm*—Herbert Dubno

(57) ABSTRACT

The invention relates to a roll and press lighter which is rendered child resistant by a fixed extension of the body which surrounds or bisects the lever so as to impede the user's thumb. The adult user must operate the lighter in such a way that the flesh of the user's thumb is able to depress the lever below the level of the fixed extension.

13 Claims, 5 Drawing Sheets

CHILD RESISTANT GAS LIGHTERS

The present invention relates to gas lighters of the "roll and press" type, and more specifically to child resistant lighters.

Roll and press gas lighters of the type used for lighting cigarettes are well known. A lighter of this type has a gas reservoir, a gas regulation system including a valve open/close system lifted and closed by a lever, and a wheel ignition mechanism. The ignition mechanism preferably comprises a spark-wheel disposed midway between two thumb-wheels whose diameter is larger than the spark-wheel. The spark-wheel rubs frictionally against a flint when rotated, in order to project sparks above the opened burner and therefore to produce a flame.

It is important to prevent the use of such lighters by children under the age of 5 years. Since 1994, the US authorities have specified the test for whether a lighter is child resistant by the CPSC Rules & Regulations.

Many child resistant lighter mechanisms have been proposed. There are two broad techniques for child resistance. Most systems use a lever mechanism having two positions; one where the mechanism is prevented from working (the lighter cannot function properly), and a second where the mechanism is manipulated (by displacement, pivoting, etc) to a position where the lighter can function and produce a flame. The mechanism resets automatically to its original position after the lighter has been used. In the other type of mechanism, the unlocking system is in the wheel assembly area in order to minimize the time the user takes to learn how to operate it. Usually, these systems do not use purely mechanical interlocking means as described above, but rather involve properties or parts which make the operation difficult for children while still easy to operate by adults.

There are many examples of the latter type of system. There is, for instance, U.S. Pat. No. 5,096,414, Zellweger/Parnet, in which the thumb-wheels are freely rotatable relative to the spark-wheel and the user has to press on the wheel assembly hard enough for the pulp of their thumb to bulge down between the thumb-wheels and engage with the spark-wheel.

Similarly in U.S. Pat. No. 5,897,307 the shield is extended around the spark wheel of the lighter so that direct access to the spark wheel to rotate it to operate the lighter is difficult, whereas operation of the lighter is possible by normal use by an adult by means of the pulp of the users thumb extending between the sides of the shield member to contact the spark wheel.

However both of these two types of lighter require the user to grip the spark wheel itself which can be uncomfortable and cause dirt to adhere to the users thumb.

WO-A-99/46539 discloses a lighter with an ignition resistance button B which is biased upwardly by a spring S and which hinders the child's ability to engage the lever by means of the spring force provided by the spring S. This lighter has the disadvantage that some adult users may have difficulty providing sufficient force to depress the resistance button if the spring force is too great. Also some children may have sufficient strength to operate the lighter and also use different methods of igniting the lighter by sliding the head of the lighter against a surface of a table of floor which would enable a child to apply sufficient force against the resistance button B to ignite the lighter.

These and other systems are costly to manufacture and/or can too readily catch the eyes of children and induce them to try to find the trick of operating them too easily.

The object of the present invention is to provide an improved gas lighter which alleviates or overcomes these problems.

It is also an object of the present invention to provide an effective child resistant lighter which can be manufactured cheaply in large volumes.

Accordingly the present invention provides a child resistant lighter of the roll and press type, having a lighter body and an operating lever including an operating end and pivoted beneath a spark wheel assembly, the operating end of the lever being depressible by a digit of a user to operate the lever to release the gas required to ignite the lighter, characterized in that the said operating end is adjacent to a fixed impeding member, the said impeding member impeding the user's digit in depressing the said operating end.

According to a further aspect of the invention, a child resistant lighter of the roll and press type is provided, having a lighter body and an operating lever including an operating end and pivoted beneath a spark wheel assembly, and having a compensating spring arranged at the valve end of the lever, characterized in that the required movement of a user's digit in operating the said operating end is impeded by an impeding member, the operating end of the lever and the impeding member being so mutually arranged that the lever may be depressed to a first extent without the user's digit being impeded by the impeding member, without causing the gas to be released.

According to a further aspect of the invention, a child resistant lighter of the roll and press type is provided, having a lighter body and an operating lever including an operating end and pivoted beneath a wheel assembly, characterized in that the lighter body forms a wall which extends upwardly and surrounds the operating end of the lever, thereby partially enclosing the lever so as to impede the required movement of a user's digit in operating the operating end.

Preferably the impeding member is fixed with respect to the body of the lighter. The impeding member may surround the operating end of the lever.

Preferably the operating end of the lever is depressed by deformation of a users digit.

Preferably the impeding member extends to a level which corresponds approximately to the plane of the operating surface of the lever.

Preferably the lighter comprises a compensating spring arranged at the valve end of the lever to maintain the burner/valve closed, and that such that the impeding member and the operating end of the lever are so mutually arranged that the lever may be depressed to a first extent without being impeded by the impeding member, without causing the burner/valve to open, and depression of the lever to a subsequent extent is impeded by the impeding member and is achievable only by deformation of an adult user's digit.

The result is a child resistant lighter which can conveniently be operated which requires no significant learning effort on the part of the user, in which the possibility of inadvertent ignition other than by the correct specified method is small, and which is relatively cheap and easy to manufacture.

A lighter embodying the invention will now be described, by way of example, with reference to the drawings, in which.

Figure 1:
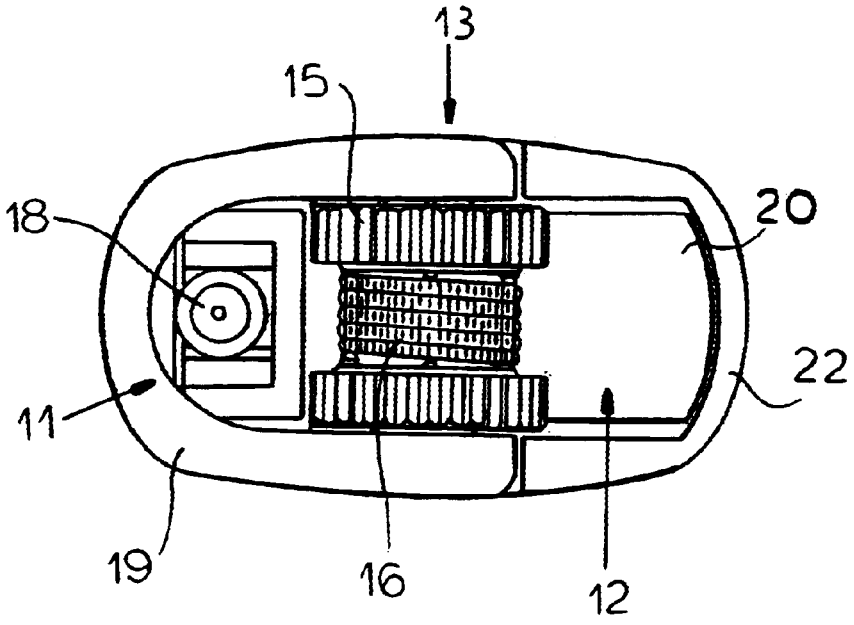
FIG. 1 is a top view of a first embodiment of the lighter.
Figure 2:
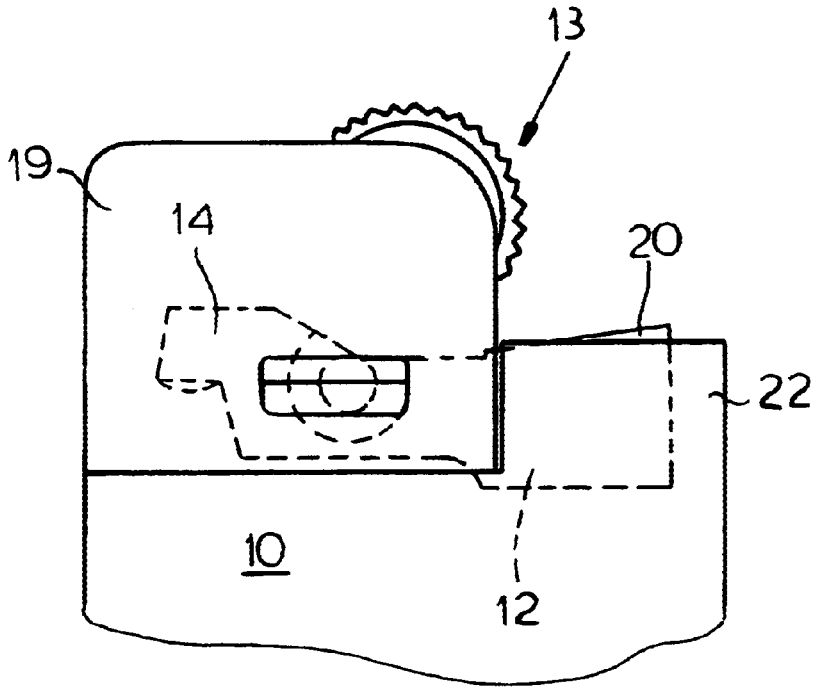
FIG. 2 is a side view of the lighter of FIG. 1.

Referring to FIG. 1 and FIG. 2 of the drawings, the lighter has a gas reservoir 10, a gas regulation system including a valve open/close system 11 lifted and closed by a lever 12, and a wheel ignition mechanism 13. The ignition mechanism comprises a spark-wheel 16 disposed midway between two thumb-wheels 15 whose diameter is larger than the spark-wheel. The spark-wheel rubs frictionally against a spring-loaded flint (not shown) located beneath it when rotated, in order to project sparks above the opened burner or jet 18 and therefore to produce a flame which forms above the shield or cap 19 around the jet 18.

The lever 12 passes beneath the wheel assembly 13 and is pivoted beneath the wheel assembly 13. The end 14 towards the front of the lighter operates the valve open/close mechanism 11; the other end comprises an operating portion 20 which is pressed down by the user as the user's thumb slides around the wheel assembly and then downwards. To ignite a lighter of this type successfully requires a two-step movement, which has to be achieved in a fraction of second. The first step requires rotating the ignition mechanism (wheel assembly) with enough speed to produce enough sparks in front of the burner. This operation is immediately followed by the depression of the right-hand end of the lever 12.

In the embodiment shown in FIGS. 1 and 2, the rear or back side of the lighter has a shroud or wall 22 extending upwardly from the main body of the lighter whose height matches the height of the operating portion 20 of the lever 12, thereby partially enclosing it. During operation of this lighter, the user will contact the thumb wheel and rotate it in the usual way and follow this immediately with a pressing action on the operating portion 20 of the lever 12, The user's thumb will be inhibited from further progress by the wall 22 and will deform around the wall 22 such that the pulp of the user's thumb continues to act against the operating portion 20 of the lever 12 to a sufficient extent to cause the lever to be depressed.

The pressure on the lever 12 to lift the burner in order to release gas is achieved by the user carrying out the same pressing down action with their thumb. A child's thumb is however smaller and will have difficulty in reaching the portion to be depressed; the child's thumb will press on the wall, which will not lift the burner control. Since the lever is smaller than or not protruding sufficiently above the walls of the lighter, this is much more difficult for children as they have less force, less pulp on the fingers, and smaller thumbs. However, nothing really changes for adult, as the pulp on their thumbs is sufficient to depress the lever.

Although other embodiments may be envisaged, in this embodiment the wall 22 is formed as an integral part of the body of the lighter and moulded in a single piece with the body of the lighter. Thus the costs of the lighter are maintained equivalent to those of a conventional lighter.

Figure 3:
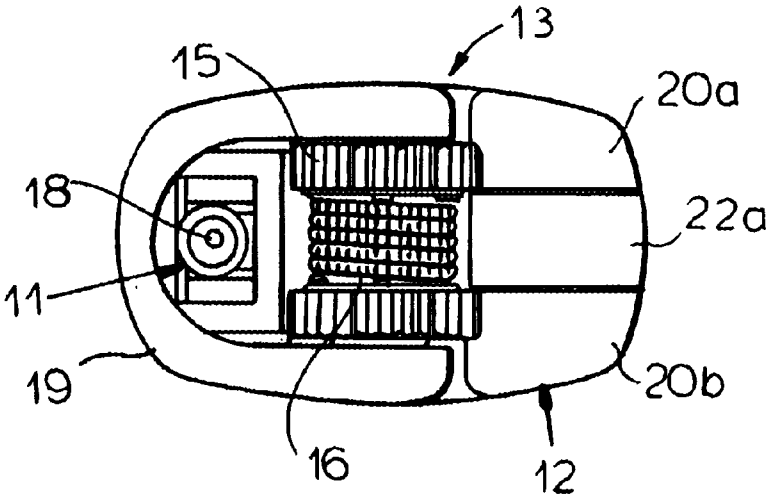
FIG. 3 is a top view of a second embodiment if the lighter.
Figure 5:
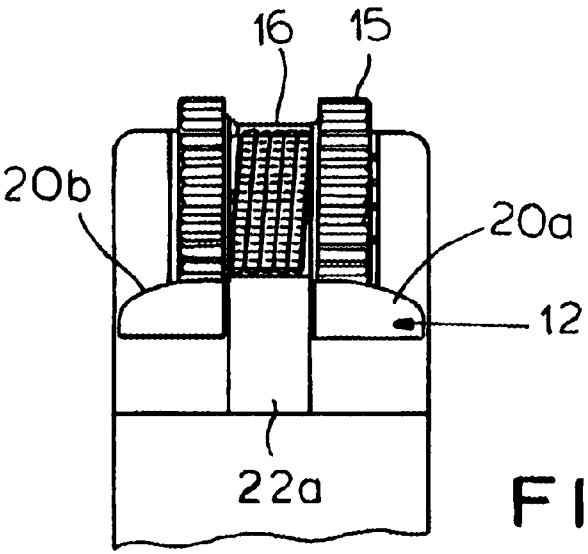
FIG. 5 is an operating end view of the lighter of FIG. 3.
Figure 4:
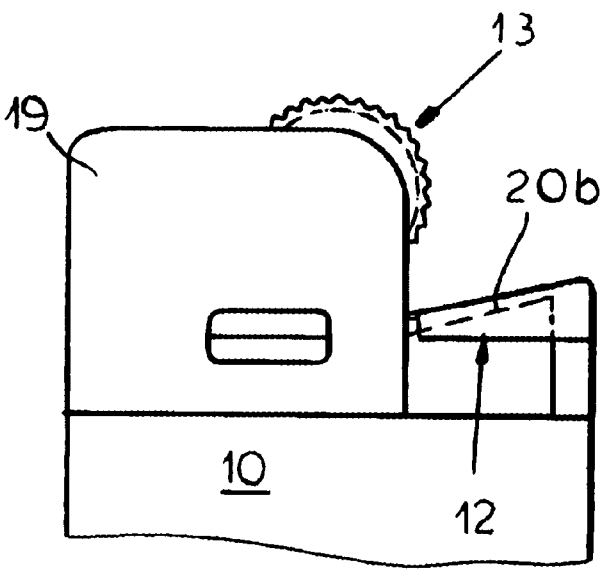
FIG. 4 is a side view of the lighter of FIG. 3.

FIGS. 3 to 5 show a further embodiment of the lighter of the invention in which corresponding parts are shown with the same identifying numerals. In this embodiment however the lever is split into three separate parts at the operating region so that there are two operating surfaces 20*a*, 20*b*. These operating surfaces 20*a*, 20*b* are arranged on either side of an impeding portion 22*a* which extends upwardly from the wall of the lighter and is fixed with respect to the lighter body.

SPECIFIC DESCRIPTION

Thus during use of this lighter the users thumb operates the thumb wheel in the usual way followed by a pressing action on the lever. However this pressing action is impeded by the impeding portion 22*a* and the user's thumb or digit is able to depress the lever only by the extent to which the user's thumb or digit can deform on either side of the impeding member by a sufficient extent. In the preferred embodiment the height of the impeding member 22*a* will be arranged so that the large majority of adult users are able to operate the lighter by means of their thumbs being sufficiently large to deform around the impeding member 22*a* to depress the operating surfaces 20*a*, 20*b* of the lever 12 to a sufficient extent to release the gas to operate the lighter.

Notwithstanding that the lever has two operating surfaces, it may be made from a single moulding of the lever component as a whole as is the case with conventional lighters and similarly the impeding member may be formed integrally with the body of the lighter as a single moulding. Thus the number of components used is no different to a conventional lighter and the manufacturing costs are therefore comparable.

It will be appreciated that the operating surfaces 20*a*, 20*b* of the lever 12 may be arranged in different orientations with respect to the impeding member 22*a*. For example it would also be possible for the impeding member to be arranged in two parts rather as the operating members 20*a*, 20*b* in FIG. 3 on either side of a central operating member of the lever 12. In this possible alternative the thumb of the user would deform into the space between the two impeding members to depress the centrally located lever 100.

It will be appreciated that many other physical constructions of the relative operating surfaces of the lever on the one hand and the impeding member on the other could be imagined within the scope of the present invention.

Different geometries can be used to achieve the best compromise between child resistance and user friendliness, by varying the shape of the lever, the shape of the walls of the lighter, and the extent to which the walls of the lighter protect or shroud the lever. Protrusion of the walls above the lever is not absolutely required; the lever can slightly protrude by a certain pre-defined distance in order to allow for the release of the gas when the lever reaches a certain extent of depression.

A compensating spring can be added to provide an improved valve operation by more accurate control of he release of gas and is usually arranged between the underneath of the valve end of the lever and the burner/valve body. The compensating spring has the effect of taking up any play between the lever and the valve which improves the open/close function of the valve and lever operation and in particular ensures that the valve shuts off properly when the lever is released.

As with the first embodiment the operating surface of the lever may protrude beyond the impeding member to such an extent that permits the lever to be depressed by an amount which causes the compensating spring at the valve end of the lever to be released, but beyond this point at least the further movement of the lever, which would result in the release of gas, is impeded by the impeding member.

Figure 6:
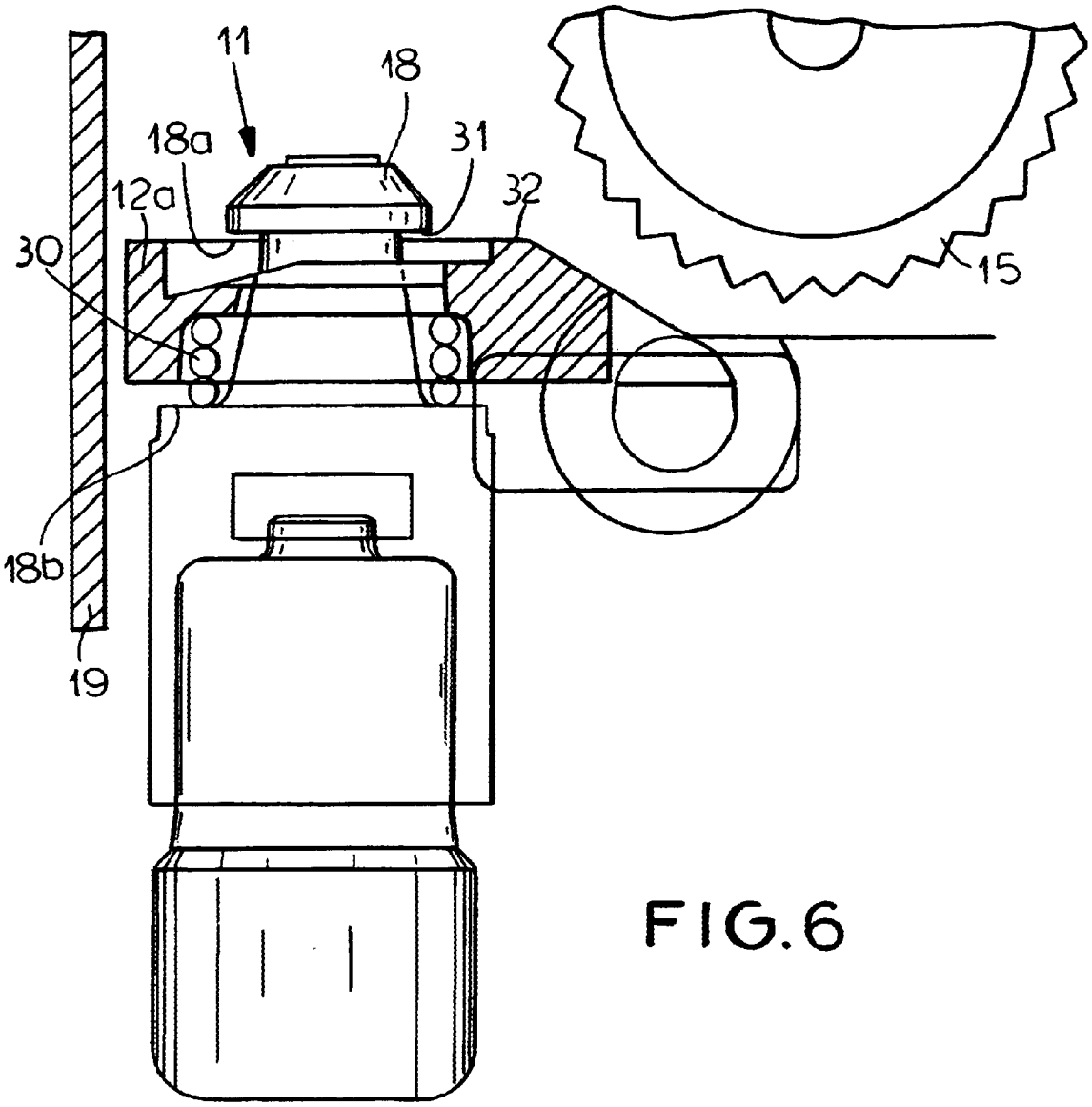
FIG. 6 is an enlarged view of the valve end of the lever of a lighter according to the invention in a first position of the lever.
Figure 7:
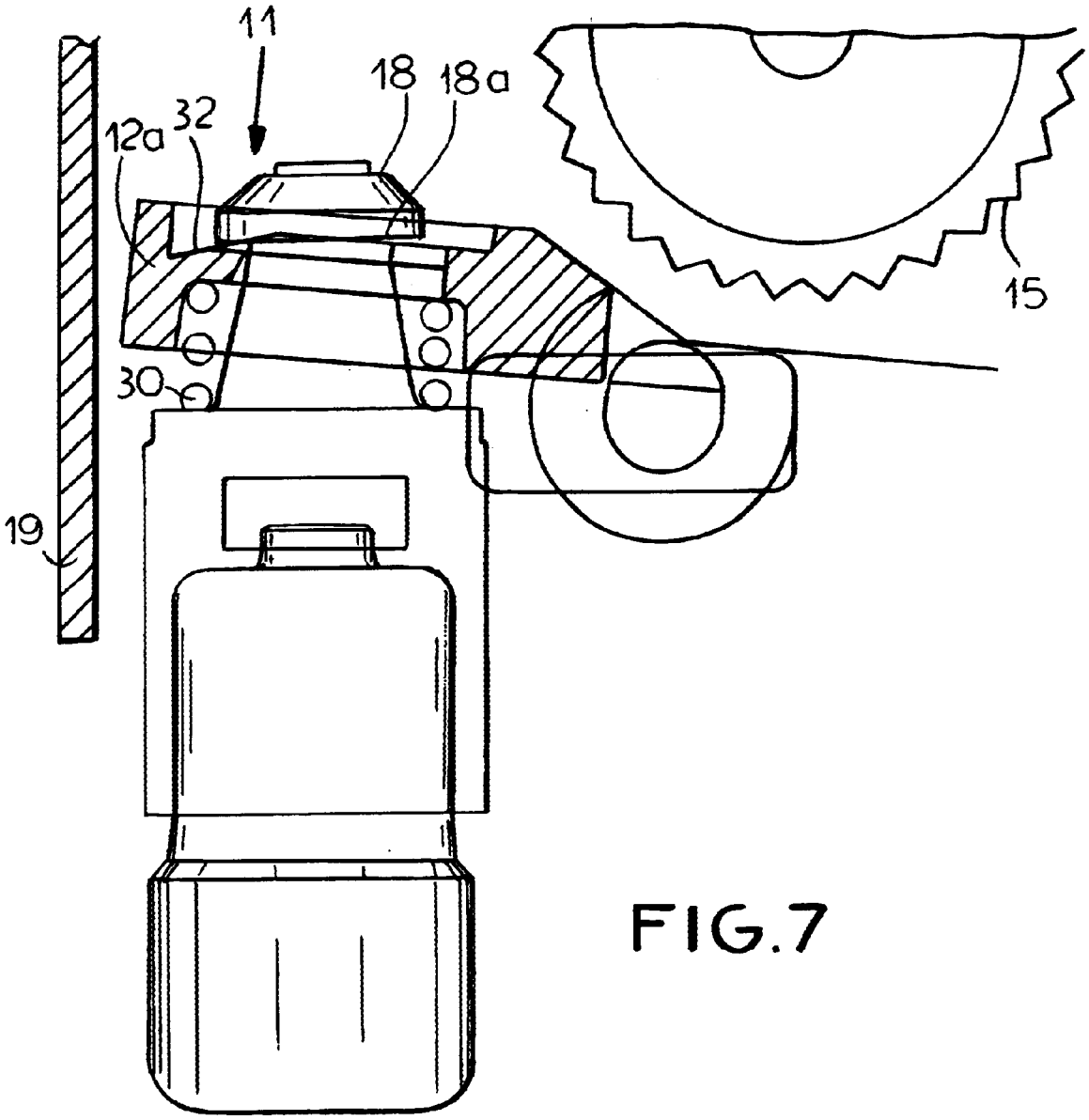
FIG. 7 is the same view as FIG. 6 in a second position of the lever.
Figure 8:
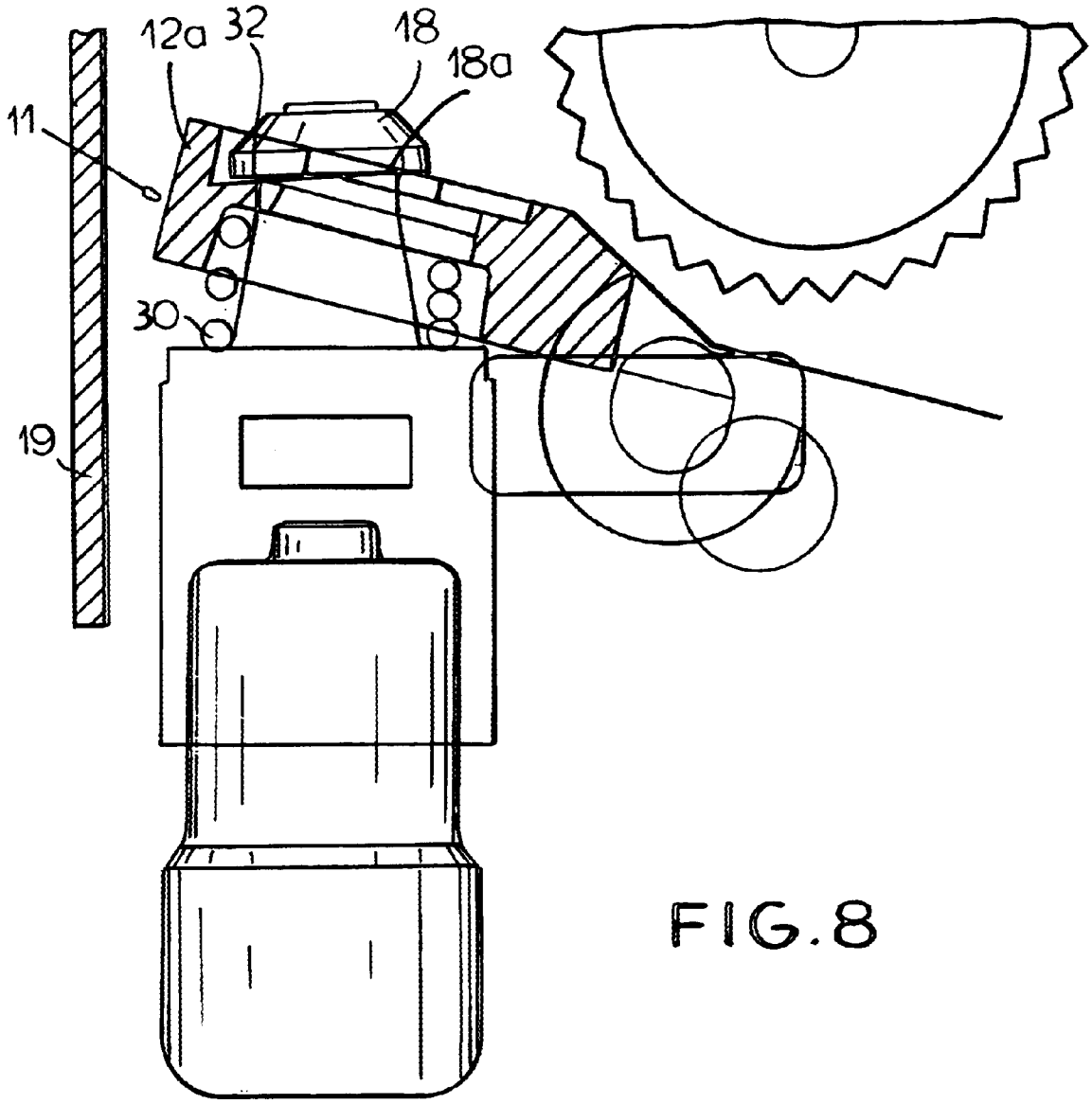
FIG. 8 is the same view as FIG. 6 in a third position of the lever.

In both of the described embodiments of the present invention, when the operating surface 20 of the lever 12 is depressed by a certain initial amount, this causes the play between the lever and the valve to be taken up before the valve actually starts to open. This is shown in FIGS. 6 to 8. The actuating end 12*a* of the lever 12 is arranged to engage the valve/burner 18 to pull the valve/burner upwards to open the valve. The actuating end 12*a* thus has an upper surface 32 which acts against a downwardly facing ledge 18*a* of the valve burner 18 when the lever is depressed. In the rest position as shown in FIG. 6 there is a gap or play 31 between the upper surface 32 and the downwardly facing ledge 18*a*. A compensating spring is arranged on the underside of the actuating end 12*a* and acts against an upwardly facing ledge 18*b* of the valve/burner 18 biasing it to the closed position.

FIG. 7 shows the arrangement of the parts after an initial movement of the lever 12 during the initial stage of its depression in normal use. In this position the play 31 has been taken up and the upper surface 32 is just about to make contact with the downwardly facing ledge 18*a* of the valve/burner 18 but is not yet pressing the valve/burner 18 upwards. The compensating spring 30 is extended but still acts against the upwardly facing ledge 18*b* of the valve/burner 18 to maintain the valve/burner closed. This initial movement of the lever is therefore permitted without the emission of gas and without the lighter being able to be operated. Finally in FIG. 8 the lever 12 is depressed to its fullest extent and the contact between the upper surface 32 and the ledge 18*a* causes the valve/burner to move upwards and therefore anuls the action of the compensating spring 30 and opens the valve. This is taken into account when varying the shape of the lever, the shape of the walls of the lighter, and the extent to which the walls of the lighter protect or shroud the lever, to achieve the right balance between child resistancy on the one hand and adult usability on the other. The lever may protrude beyond the wall 22.

It will be appreciated that there are a number of alternative embodiments which would fall within the scope of the present invention described above and defined in the attached claims.

I claim:

1. A child resistant lighter of the roll and press type, having a lighter body and an operating lever including an operating end and pivoted beneath a spark wheel assembly, the operating end of the lever being depressible by a digit of a user to operate the lever to release the gas required to ignite the lighter, wherein the said operating end is adjacent to a fixed impeding member, the said impeding member being positioned to be engaged directly by the digit of the user as the said digit depression said operating end, thereby impeding the user's digit in depressing the said operating end.

2. A child resistant lighter according to claim 1 wherein the impeding member is formed integrally with the body of the lighter.

3. A child resistant lighter according to claim 1 wherein the impeding member partially surrounds the operating end of the lever.

4. A child resistant lighter according to claim 1 wherein the operating end of the lever partially surrounds the impeding member.

5. A child resistant lighter according to claim 1 wherein the impeding member extends to a level which corresponds approximately to the plane of the operating surface of the lever at the point at which further movement of the lever will cause the burner valve to open.

6. A child resistant lighter according to claim 1 wherein the operating end of the lever is depressed by deformation of a user's digit.

7. A child resistant lighter according to claim 1 wherein the lighter includes a compensating spring arranged at the valve end of the lever to maintain the burner valve closed, and in that the impeding member and the operating end of the lever are so mutually arranged that the lever may be depressed to a first extent without being impeded by the impeding member, without causing the burner valve to open, and depression of the lever to a subsequent extent is impeded by the impeding member and is achievable only by deformation of an adult user's digit.

8. A child resistant lighter according to claim 7 wherein the operating end comprises an operating surface which is depressible by deformation of a digit of a user.

9. A child resistant lighter of the roll and press type, having a lighter body and an operating lever including an operating end and pivoted beneath a wheel assembly, characterized in that the lighter body forms a wall which extends upwardly and surrounds the operating end of the lever, thereby partially enclosing the lever so as to impede the required movement of a user's digit in operating the operating end.

10. A child resistant lighter according to claim 9 wherein the lighter body extends to a level which corresponds approximately to the plane of the operating surface of the lever which is engaged by a user's digit.

11. A child-resistant lighter comprising:

a lighter body;

a gas-release assembly at an upper end of said body;

a roll igniter on said end of said body comprising a pair of wheels and a striker between said wheels and of a smaller diameter than that of said wheels for striking sparks to ignite a flame at said gas-release assembly;

a lever mounted on said end of said body and having a first extremity adapted to unblock said gas-release assembly upon depression of an opposite extremity of said lever and automatically closing said gas-release assembly upon release of said other end of said lever; and a formation fixed to said body and located adjacent said other end of said lever at a level below a level of said other end of said lever sufficient to impede further depression of said other end of said lever by a child but shaped to permit further depression by the ball of a thumb of an adult the formation being positioned to be engaged directly by the digit of the user acting upon said other end as the said digit depresses said other end, thereby impeding the user's digit in depressing the said other end.

12. The child resistant light defined in claim 11 wherein said formation is a wall rising from said body and partly surrounding said other end of said lever.

13. A child resistant lighter of the roll and press type, having a lighter body and an operating lever including an operating end and pivoted beneath a spark wheel assembly, and having a compensating spring arranged at the valve end of the lever, wherein the required movement of a user's digit in operating the said operating end is impeded by an impeding member, the operating end of the lever and the impeding member being so mutually arranged that the lever may be depressed to a first extent without the user's digit being impeded by the impeding member, without causing the gas to be released, the said impeding member being positioned to be engaged directly by the digit of the user as the said digit depression, said operating end, thereby impeding the user's digit in depressing the said operating end further.

* * * * *